US007172187B2

(12) United States Patent
Terao et al.

(10) Patent No.: US 7,172,187 B2
(45) Date of Patent: Feb. 6, 2007

(54) WAITING TRAY FOR SHEET PROCESSING TRAY

(75) Inventors: Yasunobu Terao, Tagata-gun (JP); Hiroyuki Taki, Tagata-gun (JP); Mikio Yamamoto, Tagata-gun (JP); Hajime Yamamoto, Mishima (JP); Yoshiaki Sugizaki, Sunto-gun (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/008,295

(22) Filed: Dec. 10, 2004

(65) Prior Publication Data

US 2006/0066029 A1 Mar. 30, 2006

(30) Foreign Application Priority Data

Sep. 28, 2004 (JP) ..... 2004-282209

(51) Int. Cl.
*B65H 39/00* (2006.01)
*B65H 29/26* (2006.01)

(52) U.S. Cl. ..... 270/58.08; 270/58.11; 270/58.12; 270/58.14; 270/58.18; 271/189; 271/190; 271/191; 271/192; 399/410

(58) Field of Classification Search ..... 270/58.08, 270/58.11, 58.12, 58.14, 58.18; 399/410; 271/189, 190, 191, 192
See application file for complete search history.

(56) References Cited

U.S. PATENT DOCUMENTS 4,473,425 A 9/1984 Baughman et al.
4,611,741 A 9/1986 Wilson
4,794,859 A 1/1989 Huseby et al.
4,898,374 A 2/1990 Vermaat
5,098,074 A 3/1992 Mandel et al.
5,112,034 A 5/1992 Uto et al.
5,282,611 A * 2/1994 Ueda et al. ..... 270/58.09

(Continued)

FOREIGN PATENT DOCUMENTS

JP 62-008965 A 1/1987

(Continued)

OTHER PUBLICATIONS

U.S. Appl. No. 11/008,122, filed Dec. 10, 2004, Sasahara.

(Continued)

*Primary Examiner*—Gene O. Crawford
*Assistant Examiner*—Leslie A. Nicholson, III
(74) *Attorney, Agent, or Firm*—Foley & Lardner LLP

(57) ABSTRACT

A waiting tray is provided in a sheet-conveying path and holds sheets if the sheets need to be post-processed. A processing tray receives sheets conveyed from the waiting tray. It may receive sheets conveyed through the sheet-conveying path and coming not via the waiting tray, before the sheets are post-processed. A conveying mechanism is provided, which causes the sheets to fall, due to gravity, from the waiting tray onto a processing tray. A sheet-aligning mechanism aligns the sheets on the processing tray, at their transverse edges and longitudinal edges. On the processing tray, the sheets are post-processed, forming a bundle. The conveying mechanism conveys the bundle of sheets to a storage tray. A control mechanism controls the speed of sheet-feeding rollers provided at upstream of the waiting tray, thereby to the place sheets at a preset position on the waiting tray.

17 Claims, 13 Drawing Sheets

U.S. PATENT DOCUMENTS

| | | | | |
|---|---|---|---|---|
| 5,285,249 | A | 2/1994 | Mahoney | |
| 5,289,251 | A | 2/1994 | Mandel et al. | |
| 5,435,544 | A | 7/1995 | Mandel | |
| 5,451,037 | A | 9/1995 | Lundstrom | |
| 5,628,502 | A | 5/1997 | Amarakoon | |
| 5,676,517 | A | 10/1997 | Lotz | |
| 5,709,376 | A | 1/1998 | Ushirogata | |
| 5,934,140 | A | 8/1999 | Jackson et al. | |
| 5,961,274 | A | 10/1999 | Bors | |
| 5,971,384 | A | 10/1999 | Asao | |
| 6,065,747 | A | 5/2000 | Khovaylo et al. | |
| 6,092,948 | A | 7/2000 | Altfather | |
| 6,142,461 | A | 11/2000 | Asao et al. | |
| 6,231,039 | B1 | 5/2001 | Chung | |
| 6,330,999 | B2 * | 12/2001 | Coombs et al. | 270/58.18 |
| 6,336,630 | B1 | 1/2002 | Holtman et al. | |
| 6,354,059 | B1 | 3/2002 | Yoshie et al. | |
| 6,357,753 | B1 | 3/2002 | Yamasaki et al. | |
| 6,450,934 | B1 | 9/2002 | Coombs | |
| 6,581,922 | B2 | 6/2003 | Kuwata et al. | |
| 6,641,129 | B2 | 11/2003 | Ogita et al. | |
| 6,659,455 | B2 | 12/2003 | Endo et al. | |
| 6,671,492 | B2 | 12/2003 | Mimura et al. | |
| 6,698,744 | B2 | 3/2004 | Yamada et al. | |
| 6,712,349 | B2 | 3/2004 | Watanabe | |
| 6,722,646 | B2 | 4/2004 | Sekiyama et al. | |
| 6,722,650 | B1 | 4/2004 | Abbata et al. | |
| 6,733,006 | B2 | 5/2004 | Kobayashi et al. | |
| 6,733,007 | B2 | 5/2004 | Sekiyama et al. | |
| 6,767,012 | B2 | 7/2004 | Sasamoto | |
| 6,819,906 | B1 | 11/2004 | Herrmann et al. | |
| 6,824,128 | B2 | 11/2004 | Nagata et al. | |
| 6,871,042 | B2 | 3/2005 | Nemura et al. | |
| 6,910,686 | B2 | 6/2005 | Awano | |
| 6,928,259 | B2 | 8/2005 | Sakuma | |
| 6,988,728 | B2 | 1/2006 | Kida | |
| 2002/0047233 | A1 | 4/2002 | Coombs et al. | |
| 2002/0163119 | A1 | 11/2002 | Kawata | |
| 2003/0057625 | A1 | 3/2003 | Kuwata et al. | |
| 2004/0113348 | A1 | 6/2004 | Awano | |
| 2004/0126163 | A1 | 7/2004 | Asami et al. | |
| 2004/0181308 | A1 | 9/2004 | Hayashi et al. | |
| 2005/0000336 | A1 | 1/2005 | Hattori et al. | |

FOREIGN PATENT DOCUMENTS

| | | | |
|---|---|---|---|
| JP | 04-312894 | A | 11/1992 |
| JP | 5-16569 | A | 1/1993 |
| JP | 6-99070 | B2 | 12/1994 |
| JP | 2001-089009 | A | 4/2001 |
| JP | 2003-081517 | A | 3/2003 |
| JP | 2003081517 | A * | 3/2003 |

OTHER PUBLICATIONS

U.S. Appl. No. 11/008,124, filed Dec. 10, 2004, Terao et al.
U.S. Appl. No. 11/008,131, filed Dec. 10, 2004, Terao et al.
U.S. Appl. No. 11/008,132, filed Dec. 10, 2004, Terao et al.
U.S. Appl. No. 11/008,142, filed Dec. 10, 2004, Terao et al.
U.S. Appl. No. 11/008,145, filed Dec. 10, 2004, Terao et al.
U.S. Appl. No. 11/008,147, filed Dec. 10, 2004, Terao et al.
U.S. Appl. No. 11/008,148, filed Dec. 10, 2004, Terao et al.
U.S. Appl. No. 11/008,199, filed Dec. 10, 2004, Terao et al.
U.S. Appl. No. 11/008,222, filed Dec. 10, 2004, Terao et al.
U.S. Appl. No. 11/008,224, filed Dec. 10, 2004, Terao et al.
U.S. Appl. No. 11/008,230, filed Dec. 10, 2004, Terao et al.
U.S. Appl. No. 11/008,247, filed Dec. 10, 2004, Terao et al.
U.S. Appl. No. 11/008,248, filed Dec. 10, 2004, Terao et al.
U.S. Appl. No. 11/008,251, filed Dec. 10, 2004, Terao et al.
U.S. Appl. No. 11/008,257, filed Dec. 10, 2004, Terao et al.
U.S. Appl. No. 11/008,271, filed Dec. 10, 2004, Terao et al.
U.S. Appl. No. 11/008,290, filed Dec. 10, 2004, Terao et al.
U.S. Appl. No. 11/008,294, filed Dec. 10, 2004, Terao et al.
U.S. Appl. No. 11/008,299, filed Dec. 10, 2004, Terao et al.
U.S. Appl. No. 11/008,349, filed Dec. 10, 2004, Terao et al.
U.S. Appl. No. 11/008,350, filed Dec. 10, 2004, Terao et al.
U.S. Appl. No. 11/008,381, filed Dec. 10, 2004, Terao et al.
U.S. Appl. No. 11/008,392, filed Dec. 10, 2004, Terao et al.
U.S. Appl. No. 11/008,567, filed Dec. 10, 2004, Terao et al.
Y. Terao, et al., Notice of Allowance and Fee(s) Due, U.S. Appl. No. 11/008,124, filed Sep. 30, 2005, 9 pages.
Y. Terao et al., Notice of Allowance and Fee(s) Due, U.S. Appl. No. 11/008,132, filed Oct. 6, 2005, 9 pages.
Y. Terao et al., U.S. PTO Office Action, U.S. Appl. No. 11/008,122, filed Nov. 21, 2005, 9 pages.
Y. Terao et al., U.S. PTO Office Action, U.S. Appl. No. 11/008,224, filed Nov. 21, 2005, 10 pages.
Y. Terao et al., U.S. PTO Office Action, U.S. Appl. No. 11/008,257, filed Nov. 30, 2005, 9 pages.
Y. Terao et al., U.S. PTO Office Action, U.S. Appl. No. 11/008,271, filed Nov. 30, 2005, 9 pages.
Y. Terao et al., U.S. PTO Office Action, U.S Appl. No. 11/008,290, filed Nov. 30, 2005, 9 pages.
Y. Terao et al., U.S. PTO Office Action, U.S. Appl. No. 11/008,392, filed Dec. 14, 2005, 9 pages.
Y. Terao et al., U.S. PTO Office Action, U.S. Appl. No. 11/008,294, filed Dec. 13, 2005, 9 pages.
Y. Terao et al., U.S. PTO Office Action, U.S. Appl. No. 11/008,299, filed Dec. 13,2005, 9 pages.
Y. Terao et al., U.S. PTO Office Action, U.S. Appl. No. 11/008,349, filed Dec. 13, 2005, 9 pages.
Y, Terao et al., U.S. PTO Office Action, U.S. Appl. No. 11/008,567, filed Dec. 13, 2005, 9 pages.
Y. Terao et al., U.S. PTO Office Action, U.S. Appl. No. 11/008,148, filed Jan. 11, 2006, 12 pages.
Y. Terao et al., U.S. PTO Office Action, U.S. Appl. No. 11/008,251, filed Jan. 13, 2006, 11 pages.
Y. Terap et al., U.S. PTO Office Action, U.S. Appl. No. 11/008,350, filed Jan. 26, 2006, 12 pages.
U.S. Appl. No. 11/085,226, filed Mar. 22, 2005, Terao et al.
U.S. Appl. No. 11/085,227, filed Mar. 22, 2005, Terao et al.
U.S. Appl. No. 11/085,240, filed Mar. 22, 2005, Terao et al.
U.S. Appl. No. 11/085,241, filed Mar. 22, 2005, Terao et al.
U.S. Appl. No. 11/085,242, filed Mar. 22, 2005, Terao et al.
U.S. Appl. No. 11/085,243, filed Mar. 22, 2005, Terao et al.
U.S. Appl. No. 11/085,244, filed Mar. 22, 2005, Terao et al.
U.S. Appl. No. 11/085,247, filed Mar. 22, 2005, Terao et al.
U.S. Appl. No. 11/085,248, filed Mar. 22, 2005, Terao et al.
U.S. Appl. No. 11/085,250, filed Mar. 22, 2005, Terao et al.
U.S. Appl. No. 11/085,251, filed Mar. 22, 2005, Iizuka et al.
U.S. Appl. No. 11/085,256, filed Mar. 22, 2005, Terao et al.
U.S. Appl. No. 11/085,257, filed Mar. 22, 2005, Terao et al.
U.S. Appl. No. 11/085,264, filed Mar. 22, 2005, Terao et al.
U.S. Appl. No. 11/085,625, filed Mar. 22, 2005, Terao et al.
Y. Terao et al., U.S. PTO Office Action, U.S. Appl. No. 11/008,131, filed Feb. 23, 2006, 9 pgs.
Y. Terao et al., U.S. PTO Office Action, U.S. Appl. No. 11/008,222, filed Feb. 24, 2006, 12 pgs.
Y. Terao et al., U.S. PTO Office Action, U.S. Appl. No. 11/008,230, filed Feb. 24, 2006, 11 pgs.
Y. Terao et al., U.S. PTO Office Action, U.S. Appl. No. 11/085,226, filed Jan. 13, 2006, 9 pgs.
Y. Terao et al., U.S. PTO Office Action, U.S. Appl. No. 11/085,227, filed Feb. 9, 2006, 9 pgs.
Y. Terao et al., U.S. PTO Office Action, U.S. Appl. No. 11/085,240, filed Jan. 26, 2006, 8 pgs.
Y. Terao et al., U.S. PTO Office Action, U.S. Appl. No. 11/085,241, filed Feb. 9, 2006, 9 pgs.
Y. Terao et al., U.S. PTO Office Action, U.S. Appl. No. 11/085,243, filed Jan. 26, 2006, 6 pgs.
Y. Terao et al., U.S. PTO Office Action, U.S. Appl. No. 11/085,244, filed Feb. 9, 2006, 7 pgs.
Y. Terao et al., U.S. PTO Notice of Allowance, U.S. Appl. No. 11/085,243, filed Jan. 5, 2006, with attached Notice of Withdrawal from Issue dated Jan. 10, 2006, 10 pgs.

K. Sasahara, et al., U.S. PTO Office Action, U.S. Appl. No. 11/008,122, filed Apr. 19, 2006, 10 pages.
Y. Terao et al., Notice of Allowance and Fee(s) Due, U.S. Appl. No. 11/008,199, filed Apr. 20, 2006, 15 pages.
Y. Terao et al., Notice of Allowance and Fee(s) Due, U.S. Appl. No. 11/008,247, filed May 1, 2006, 16 pages.
Y. Terao et al., Notice of Allowance and Fee(s) Due, U.S. Appl. No. 11/008,349, filed May 2, 2005, 9 pages.
Y. Terao et al., U.S. PTO Office Action, U.S. Appl. No. 11/008,224, filed Apr. 21, 2006, 12 pages.
Y. Terao et al., U.S. PTO Office Action, U.S. Appl. No. 11/008,257, filed Apr. 28, 2006, 13 pages.
Y. Terao et al., U.S. PTO Office Action, U.S. Appl. No. 11/008,271, filed Apr. 25, 2006, 14 pages.
Y. Terao et al., U.S. PTO Office Action, U.S. Appl. No. 11/008,294, filed May 5, 2006, 13 pages.
Y. Terao et al., U.S. PTO Office Action, U.S. Appl. No. 11/008,299, filed May 5, 2006, 12 pages.
Y. Terao et al., U.S. PTO Office Action, U.S. Appl. No. 11/008,392, filed Apr. 26, 2006, 10 pages.
Y. Terao et al., Notice of Allowance and Fee(s) Due, U.S. Appl. No. 11/008,148, Jun. 26, 2006, 10 pages.
Y. Terao et al., Notice of Allowance and Fee(s) Due, U.S. Appl. No. 11/008,251, Jun. 26, 2006, 10 pages.
Y. Terao et al., Notice of Allowance and Fee(s) Due, U.S. Appl. No. 11/085,241, Jun. 26, 2006, 10 pages.
Y. Terao et al., Notice of Allowance and Fee(s) Due, U.S. Appl. No. 11/085,243, Jun. 26, 2006, 10 pages.
Y. Terao et al., U.S. PTO Office Action, U.S. Appl. No. 11/008,132, Jun. 9, 2006, with attached Notice of Withdrawal from Issue dated May 30, 2006, 11 pgs.
Y. Terao et al., Notice of Allowance and Fee(s) Due, U.S. Appl. No. 11/085,244, Jul. 13, 2006, 10 pages.
Y. Terao et al., U.S. PTO Office Action, U.S. Appl. No. 11/008,145, Jun. 30, 2006, 6 pgs.
Y. Terao et al., U.S. PTO Office Action, U.S. Appl. No. 11/008,147, Jul. 7, 2006, 4 pgs.
Y. Terao et al., U.S. PTO Office Action, U.S. Appl. No. 11/008,290, Jul. 21, 2006, 15 pgs.
Y. Terao et al., U.S. PTO Office Action, U.S. Appl. No. 11/008,350, Jul. 6, 2006, 12 pgs.
Y. Terao et al., U.S. PTO Office Action, U.S. Appl. No. 11/085,226, Jul. 20, 2006, 12 pgs.
Y. Terao et al., U.S. PTO Office Action, U.S. Appl. No. 11/085,227, Aug. 11, 2006, 15 pages.
Y. Terao et al., U.S. PTO Office Action, U.S. Appl. No. 11/085,240, Aug. 2, 2006, 15 pages.
Y. Terao et al., U.S. PTO Office Action, U.S. Appl. No. 11/085,247, Jul. 13, 2006, 14 pgs.
Y. Terao et al., U.S. PTO Office Action, U.S. Appl. No. 11/085,248, Jul. 5, 2006, 15 pgs.
Y. Terao et al., U.S. PTO Office Action, U.S. Appl. No. 11/085,256, Jul. 13, 2006, 13 pgs.
Y. Terao et al., U.S. PTO Office Action, U.S. Appl. No. 11/085,625, Jul. 28, 2006, 13 pgs.
Y. Terao, et al., Notice of Allowance and Fee(s) Due, U.S. Appl. No. 11/008,122, Jul. 26, 2006, 8 pgs.
Y. Terao et al., Notice of Allowance and Fee(s) Due, U.S. Appl. No. 11/008,350, Sep. 21, 2006, 7 pages.
Y. Terao et al., Notice of Allowance and Fee(s) Due, U.S. Appl. No. 11/008,392, Sep. 15, 2006, 10 pages.
Y. Terao et al., U.S. PTO Office Action, U.S. Appl. No. 11/008,381, Aug. 23, 2006, 17 pages.
Y. Terao et al., U.S. PTO Office Action, U.S. Appl. No. 11/008,567, Aug. 21, 2006, 14 pages.
Y. Terao, et al., Notice of Allowance and Fee(s) Due, U.S. Appl. No. 11/008,222, Aug. 31, 2006, 12 pgs.
Y. Terao, et al., Notice of Allowance and Fee(s) Due, U.S. Appl. No. 11/008,299, Sep. 6, 2006, 9 pgs.
Y. Terao et al., U.S. PTO Office Action, U.S. Appl. No. 11/008,131, Oct. 17, 2006, 15 pages.
Y. Terao et al., U.S. PTO Office Action, U.S. Appl. No. 11/008,132, Nov. 24, 2006, 16 pages.
Y. Terao et al., U.S. PTO Office Action, U.S. Appl. No. 11/008,224, Nov. 17, 2006, 13 pages.
Y. Terao et al., U.S. PTO Office Action, U.S. Appl. No. 11/008,230, Nov. 13, 2006, 17 pages.
Y. Terao et al., U.S. PTO Office Action, U.S. Appl. No. 11/008,294, Oct. 24, 2006, 11 pages.
Y. Terao et al., U.S. PTO Office Action, U.S. Appl. No. 11/085,625, Nov. 21, 2006, 13 pages.
Y. Terao, et al., Notice of Allowance and Fee(s) Due, U.S. Appl. No. 11/008,257, Oct. 24, 2006, 11 pages.

* cited by examiner

WAITING TRAY FOR SHEET PROCESSING TRAY

CROSS-REFERENCE TO RELATED APPLICATIONS

This application is based upon and claims the benefit of priority from prior Japanese Patent Application No. 2004-282209, filed Sep. 28, 2004, the entire contents of which are incorporated herein by reference.

BACKGROUND OF THE INVENTION

1. Field of the Invention

The present invention relates to a sheet post-process apparatus, such as a finisher, which is designed for installation at the outlet side of a multi-function periperal (MFP).

2. Description of the Related Art

An apparatus called "finisher" is known, which receives printed sheets supplied from an MFP and staples them together. In the finisher, the sheets supplied from the MFP are sequentially conveyed to a tray and stapled by a stapler, forming a bundle of sheets. The bundle of sheets is ejected from the apparatus onto a storage tray.

Jpn. Pat. Appln. KOKAI Publication No. 6-99070 discloses a finisher. This finisher performs a post-process on sheets. In the post-process, a stapler staples sheets. To process the sheets at the same rate as the MFP processes them, it is necessary to reduce the speed at which sheets are conveyed in the finisher. The finisher therefore has a long sheet-conveying path.

Having a long sheet-conveying path, the finisher cannot be as small as desired.

Jpn. Pat. Appln. KOKAI Publication No. 5-16569 discloses a technique of detecting both of the leading edge and trailing edge of a sheet, thereby to control the speed of conveying the sheet.

BRIEF SUMMARY OF THE INVENTION

An object of the present invention is to provide a sheet post-process apparatus in which each sheet conveyed to the waiting tray can be placed at a preset position on the waiting tray.

A sheet post-process apparatus according to this invention comprises: a plurality of rollers which receive sheets from an MFP and convey the sheets forward; a waiting tray which is provided in a conveying path and holds the sheets conveyed from the rollers when the sheets need to be post-processed; a control mechanism which controls a speed of sheet-feeding rollers included in the plurality of rollers and provided at upstream of the waiting tray, thereby to place sheets at a preset position on the waiting tray; a processing tray which holds the sheets conveyed from the waiting tray and the sheets conveyed via the conveying path without being conveyed to the waiting tray, before the sheets are post-processed; a conveying mechanism which causes the sheets to fall, due to gravity, from the waiting tray onto the processing tray; a sheet-aligning mechanism which aligns the sheets with one another on the processing tray, at transverse edge and longitudinal edge, thereby forming a bundle of sheets; a post-process mechanism which performs a post-process on the bundle of sheets on the processing tray; sheet-conveying means for conveying the bundle of sheets from the processing tray; and a storage tray which holds the bundle of sheets conveyed from the processing tray.

Preferably, the control mechanism may comprises: first detecting means for detecting sheet information supplied from the MFP; second detecting means provided between the first detecting means and the waiting tray, for detecting a leading edge of a sheet; and control means for generating a control signal for controlling a speed of the sheet-feeding rollers, from the sheet information and the leading edge detected by the first and second detecting means, respectively.

It is desired that the control mechanism should control the speed of sheet-feeding rollers in accordance with job information supplied from the MFP.

Preferably, the control mechanism may control the speed of the sheet-feeding rollers in accordance with information representing a size of the sheets.

Preferably, the control mechanism may control the speed of the sheet-feeding rollers in accordance with information representing a thickness of the sheets.

In the apparatus, the waiting tray holds sheets to be post-processed. The conveying mechanism causes these sheets to fall, due to gravity, onto the processing tray. Hence, it suffices to provide a sheet-waiting section that is just as long as the waiting tray. This renders the sheet post-process apparatus small.

The sheet-feeding rollers provided immediately before the waiting tray rotate at the same high speed as the sheet-conveying rollers. If the sheets are ejected, they may stagger in the direction they are conveyed, depending upon their condition. This problem can be solved, because the control mechanism controls the speed of sheet-feeding rollers included in the plurality of rollers and provided at upstream of the waiting tray, thereby placing the sheets at a preset position on the waiting tray.

DETAILED DESCRIPTION OF THE INVENTION

An embodiment of this invention will be described, with reference to the accompanying drawings.

Figure 1:
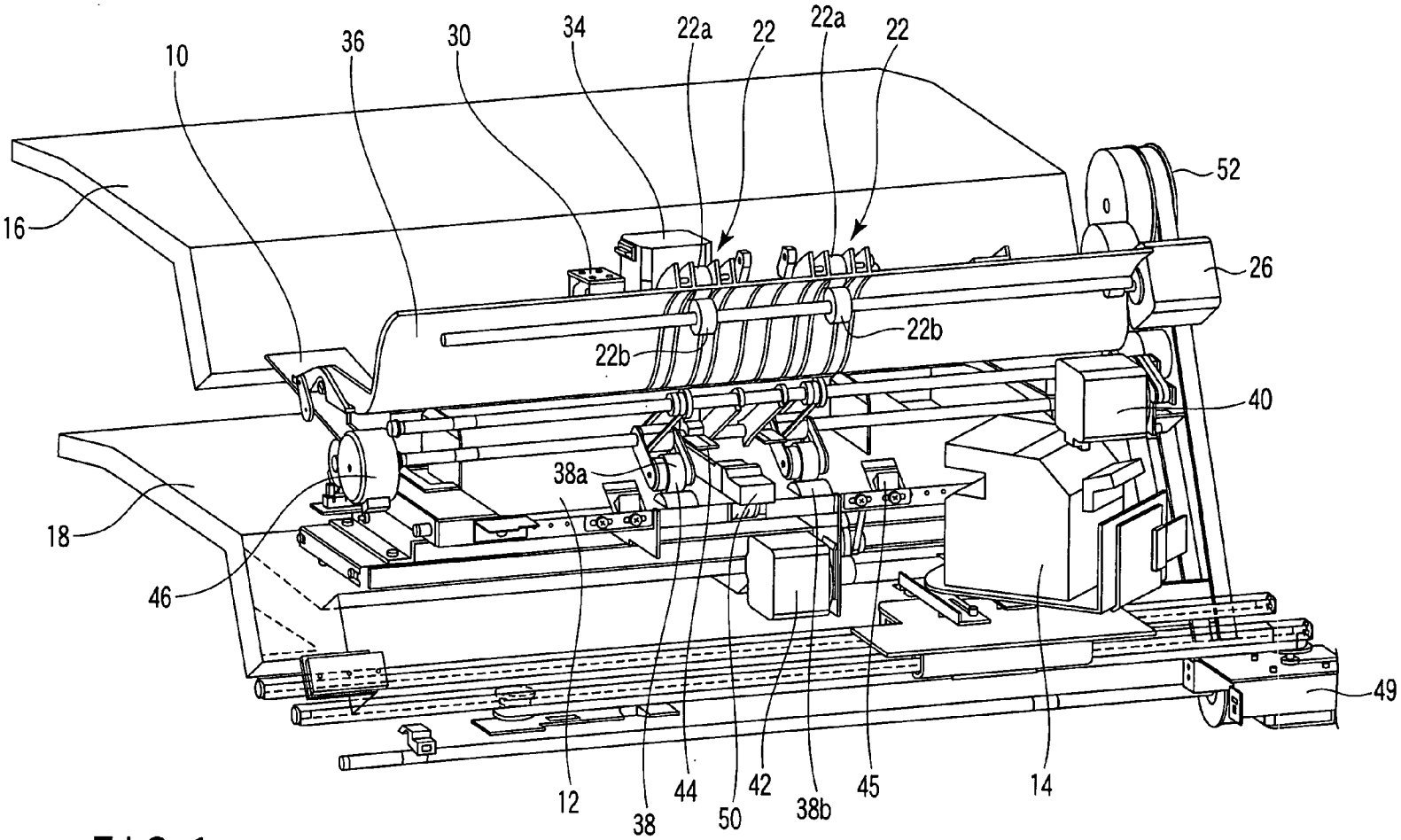
FIG. 1 is a perspective view of a post-process apparatus according to this invention.
Figure 2:
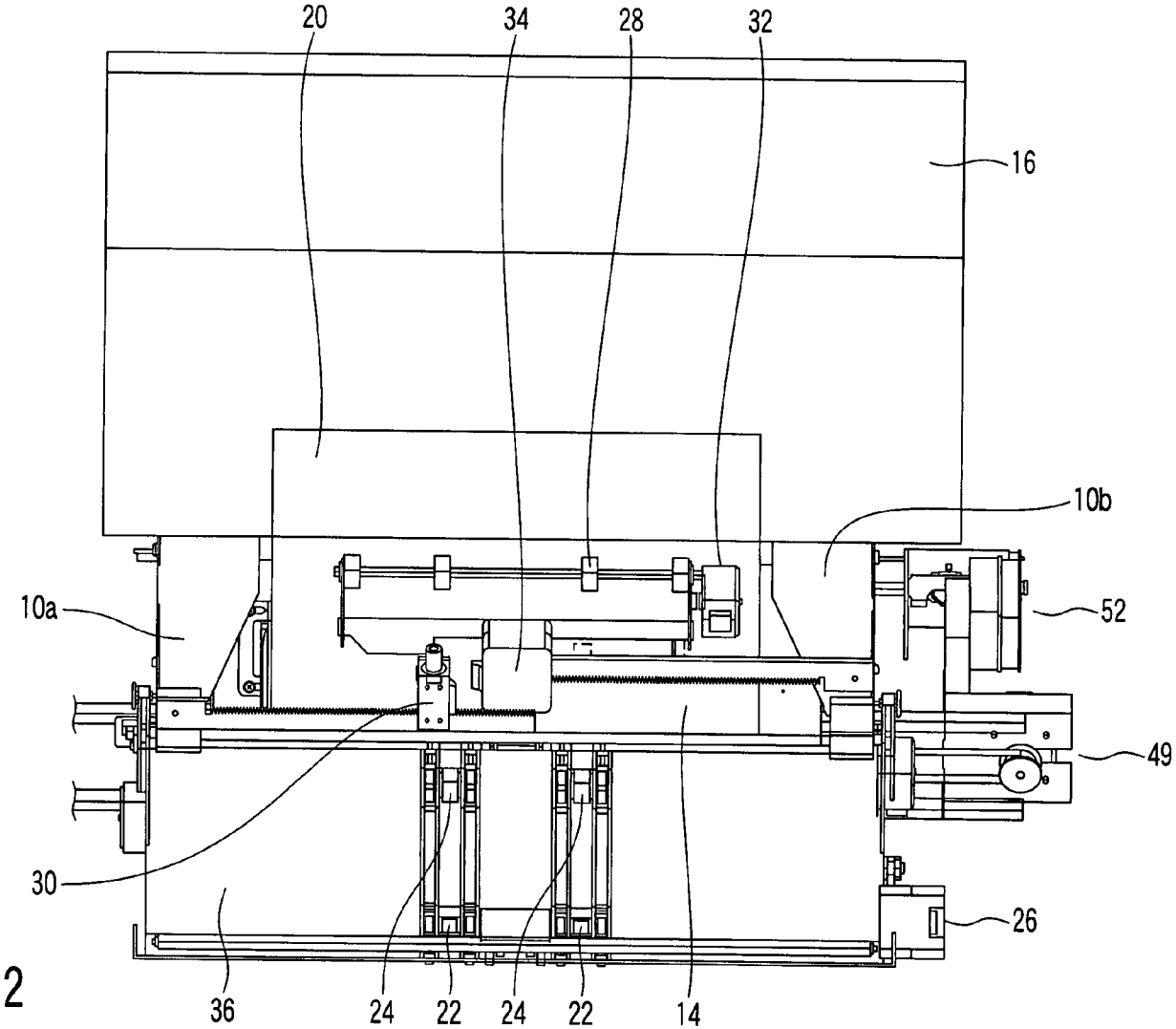
FIG. 2 is a top view of the post-process apparatus according to the invention.

FIG. 1 is a perspective view of a section of a sheet post-process apparatus according to this invention. FIG. 2 is a top view of said section of the post-process apparatus. As FIG. 1 shows, the post-process apparatus comprises a waiting tray 10, a processing tray 12, a stapler 14, a first storage tray 16, and a second storage tray 18.

The sheet post-process apparatus further comprises a pair of input rollers 22, a pair of sheet-feeding rollers 24, and an input-roller motor 26. The input rollers 22 receive a sheet 20 supplied from an MFP and convey the sheet 20 to the sheet-feeding rollers 24. The sheet-feeding rollers 24 convey the sheet 20 to the waiting tray 10. The input-roller motor 26 drives the input rollers 22.

One of the input rollers 22 is an upper input roller 22*a*, and the other input roller 22 is a lower input roller 22*b*. Likewise, one of the sheet-feeding rollers 24 is an upper sheet-feeding roller, and the other sheet-feeding roller 24 is a lower sheet-feeding roller.

The waiting tray 10 comprises two tray parts 10*a* and 10*b*. The tray parts 10*a* and 10*b* can move from left to right, and vice versa. When the tray parts 10*a* and 10*b* take a closed position, the waiting tray 10 can receive sheets. Waiting-tray rollers 28, a waiting-roller drive 30 and a waiting-roller motor 32 are provided. The waiting-tray rollers 28 align sheets on the tray parts 10*a* and 10*b* while both tray parts remain in the closed position. The waiting-tray rollers 28 can move up and down when they are driven and controlled by the waiting-roller drive 30. The waiting-roller motor 32 rotates the waiting-tray rollers 28.

Figure 3:
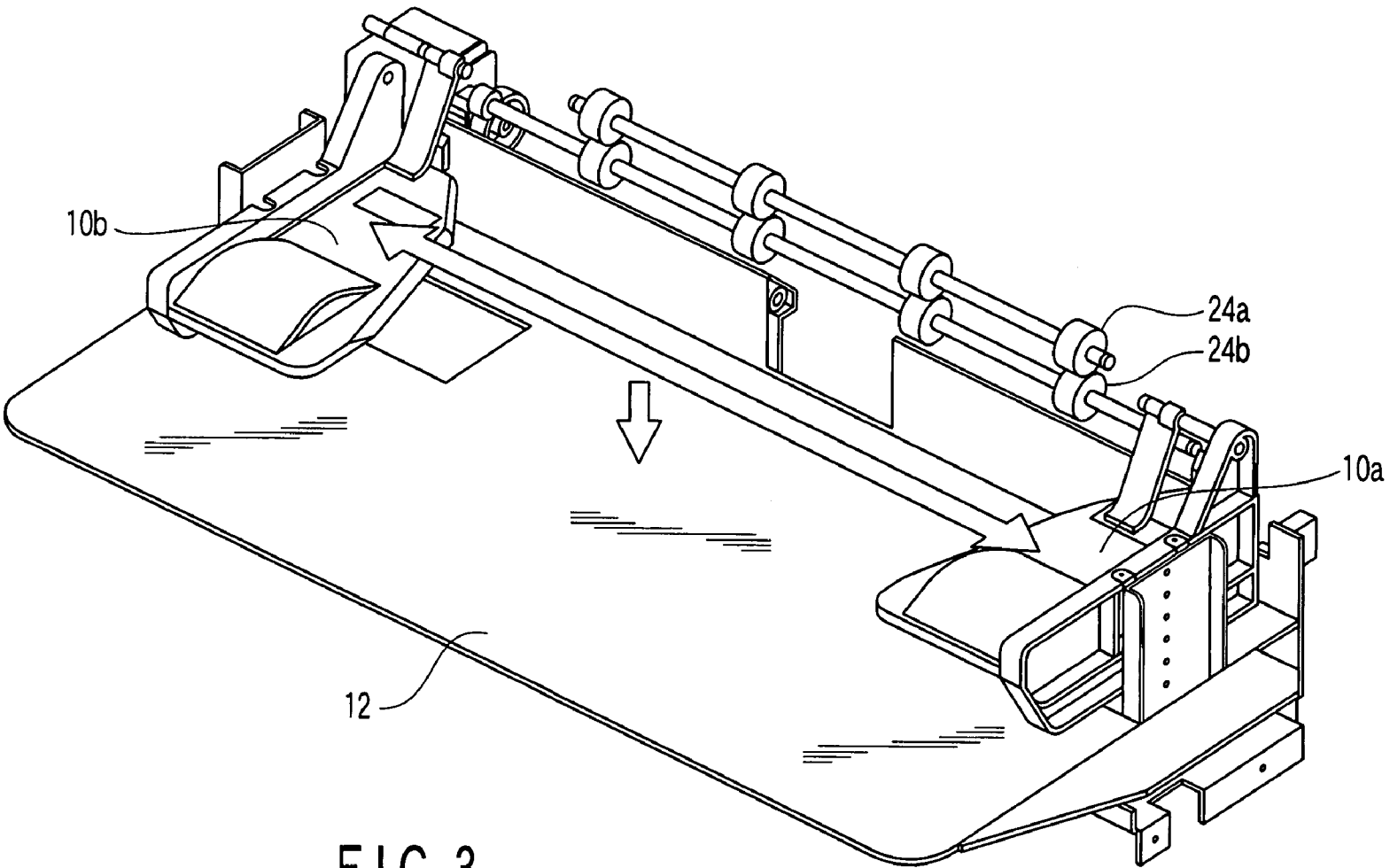
FIG. 3 is a perspective view illustrating how the waiting tray of the post-process apparatus performs its function.

When the number of sheets 20 stacked on the waiting tray 10 reaches a prescribed value, a waiting-tray motor 34 drives the waiting-tray parts 10*a* and 10*b* to an opened position as is illustrated in FIG. 3. The sheets 20 fall onto the processing tray 12, due to gravity. This event is known as "active drop."

The sheet post-process apparatus has a paper guide 36, which guides sheets from the MFP to the waiting tray 10 and thence to the processing tray 12. The paper guide 36 has a paper-pass ceiling.

Figure 4:
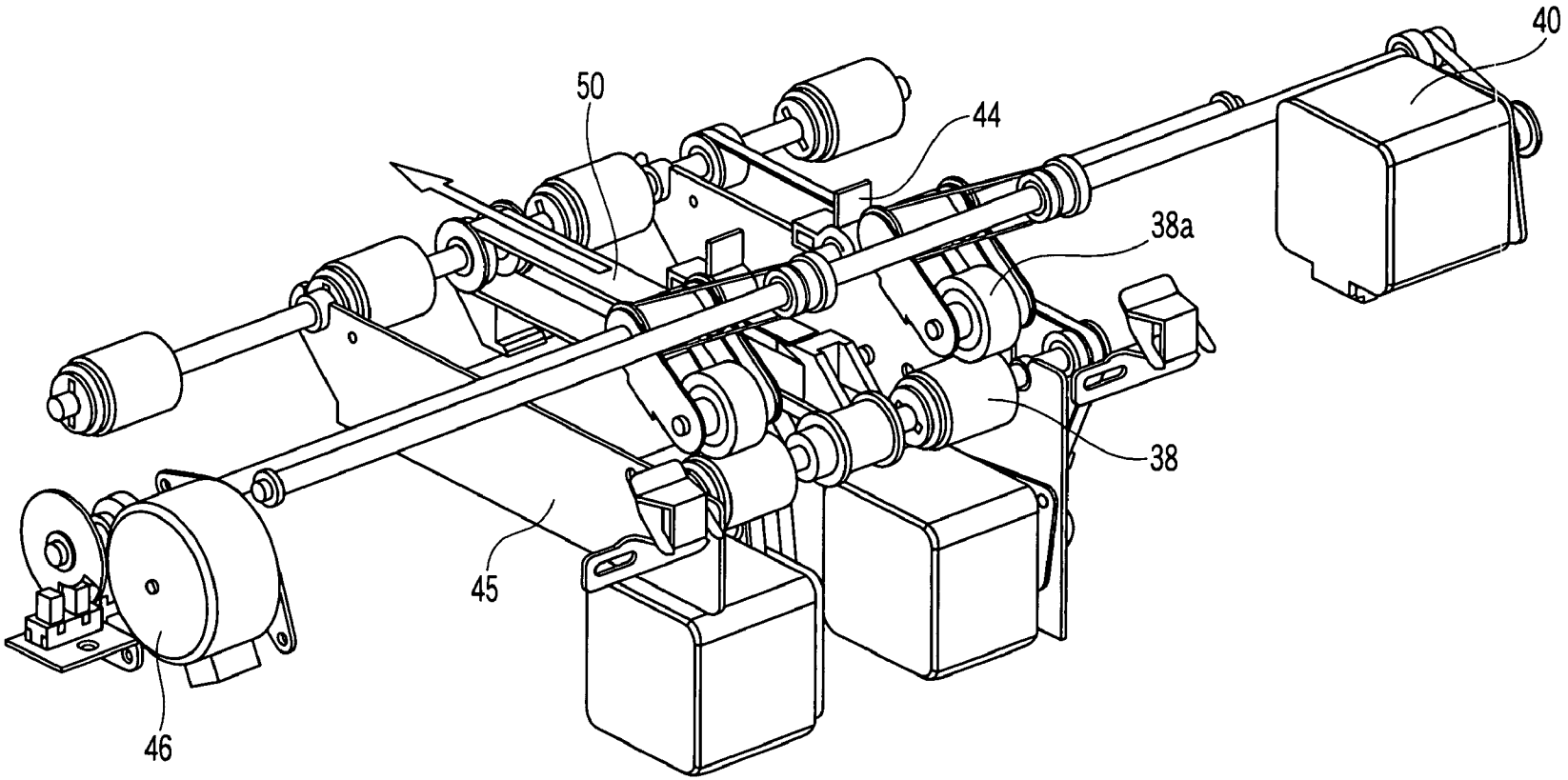
FIG. 4 is a perspective view depicting the sheet-bundle conveying mechanism provided in the post-process apparatus, and explaining how sheets are aligned at longitudinal edges in the post-process apparatus.

In the processing tray 12, the sheets are aligned at the longitudinal edges and the transverse edges. The sheets are aligned at their longitudinal edges by a longitudinal-alignment mechanism 38 as is illustrated in FIG. 4. More precisely, an upper longitudinal-alignment motor 40 drives the upper longitudinal-alignment rollers 38*a* of the mechanism 38, and a lower longitudinal-alignment motor 42 drives the lower longitudinal-alignment rollers 38*b* of the mechanism 38. Driven by the motors 40 and 42, the rollers 38*a* and 38*b* move the sheets until one longitudinal edge of every sheet abuts on a stopper 45. Paddles 44 are provided to facilitate the longitudinal alignment. A paddle motor 46 drives the paddles 44.

Figure 5:
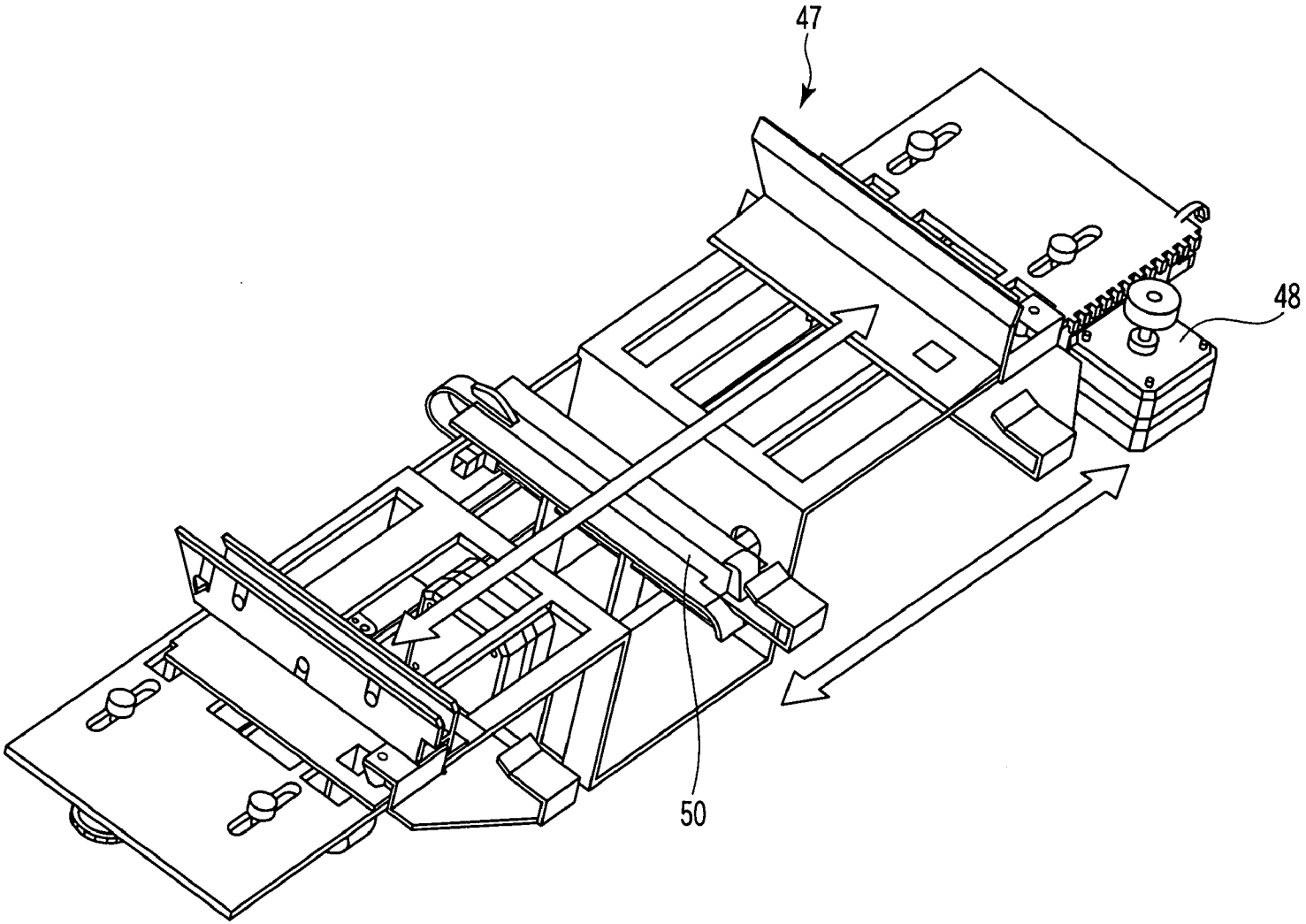
FIG. 5 is a perspective view showing the mechanism for aligning sheets at their transverse edges.

The sheets are aligned at their transverse edges, too, as is illustrated in FIG. 5. More specifically, the transverse alignment is performed by a transverse-alignment mechanism 47 and a transverse-alignment motor 48.

Figure 6:
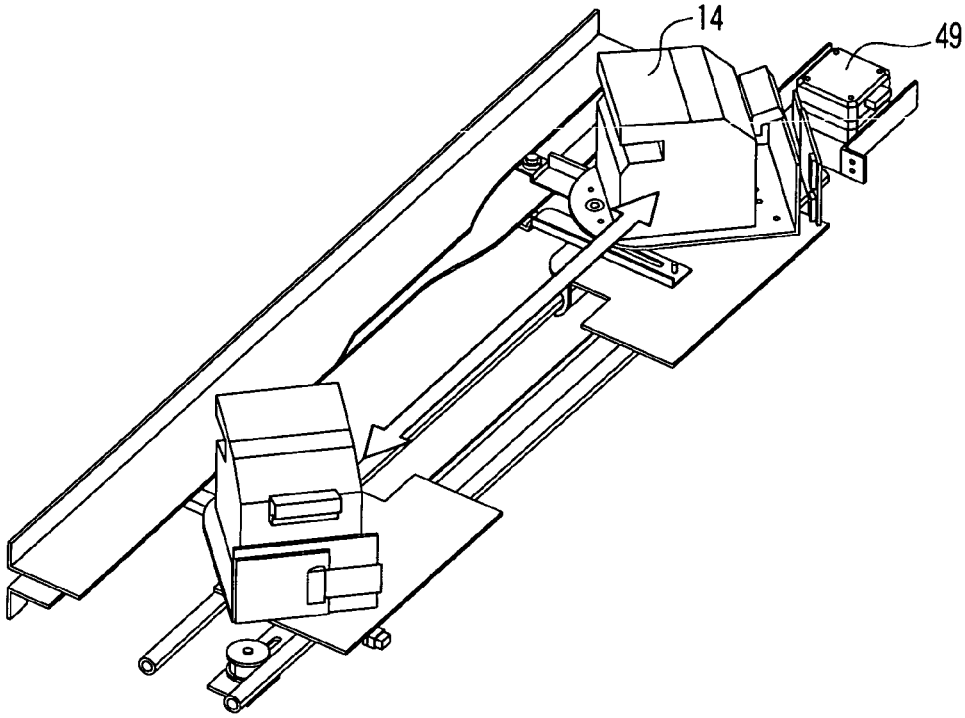
FIG. 6 is a perspective view illustrating how the stapler provided in the post-process apparatus performs its function.

When the number of sheets thus aligned in the processing tray 12 reaches the prescribed value, the stapler 14 starts operating. The stapler 14 is positioned as depicted in FIG. 6 and controlled by a stapler-driving unit 49.

Controlled by the unit 49, the stapler 14 staples the sheets together, forming a bundle of sheets. As shown in FIG. 4, a transport mechanism 50 transports the bundle of sheets to the first storage tray 16. Either the first storage tray 16 or the second storage tray 18 is selected when a storage-tray driving unit 52 (FIG. 2) moves the tray 16 or 18 to a predetermined upper position.

How the post-process apparatus according to this invention operates will be explained with reference to FIGS. 7 to 17.

Figure 7:
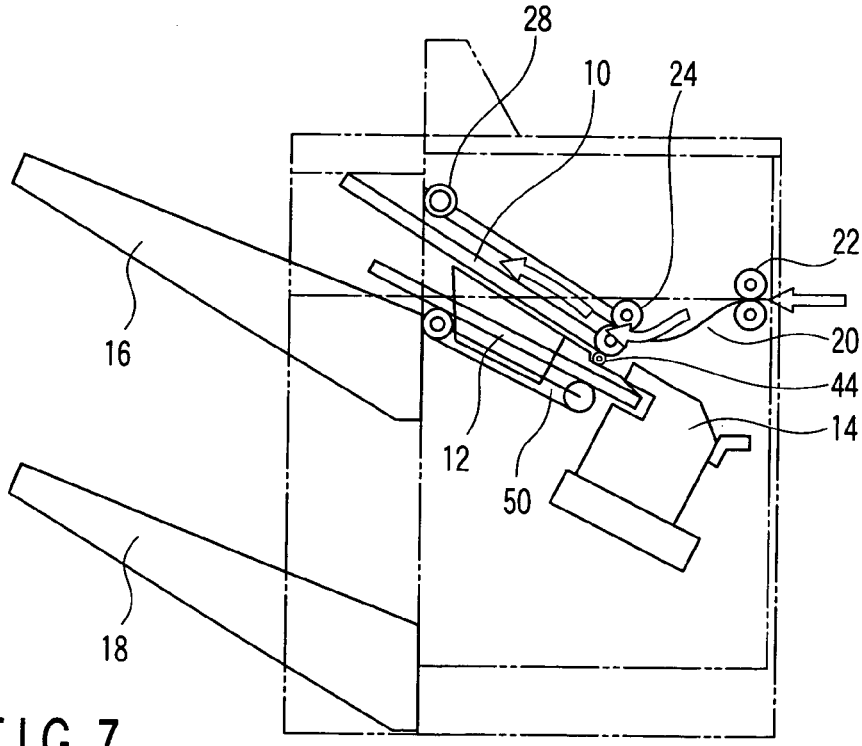
FIG. 7 is a sectional view of the post-process apparatus, showing how the first sheet moves from the input rollers to the sheet-feeding roller.

As FIG. 7 shows, a sheet 20 conveyed from the MFP is moved from the input rollers 22 to the sheet-feeding rollers 24, in the direction of the arrow.

Figure 8:
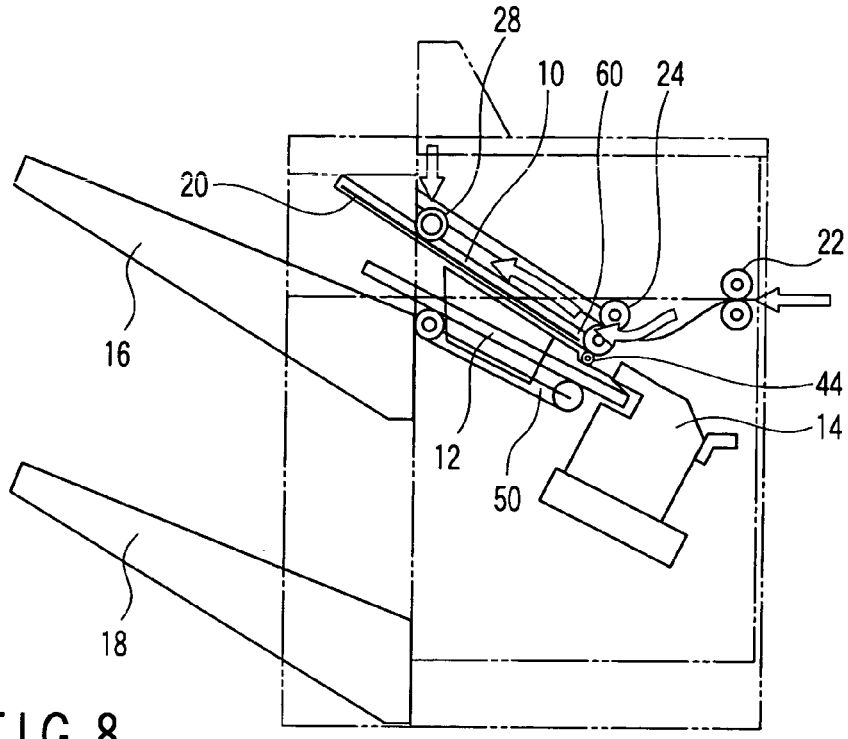
FIG. 8 is a sectional view of the apparatus, explaining how the first sheet moves from the sheet-feeding rollers to the waiting tray.

As is illustrated in FIG. 8, the sheet 20, or the first sheet, is placed on the waiting tray 10. Then, the waiting-tray rollers 28 move down, in the direction of the arrow, aligning the trailing edge of the first sheet 20 at the rear (i.e., upstream) end 60 of the waiting tray 10.

Figure 9:
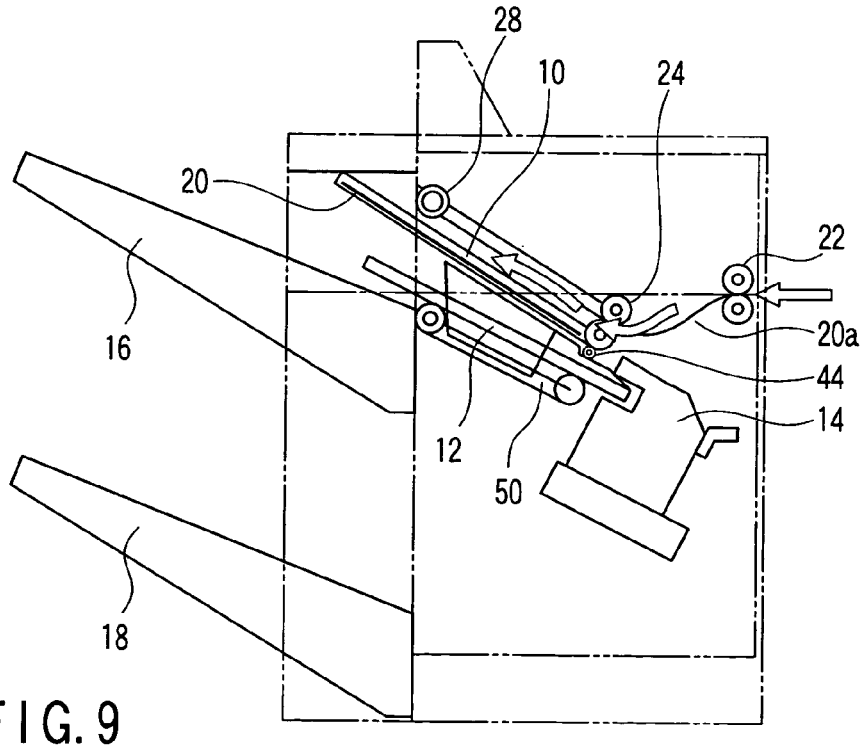
FIG. 9 is a sectional view of the apparatus, explaining how the second sheet moves from the sheet-feeding rollers to the waiting tray.

As FIG. 9 depicts, the waiting-tray rollers 28 moves up to receive the second sheet 20*a*.

Figure 10:
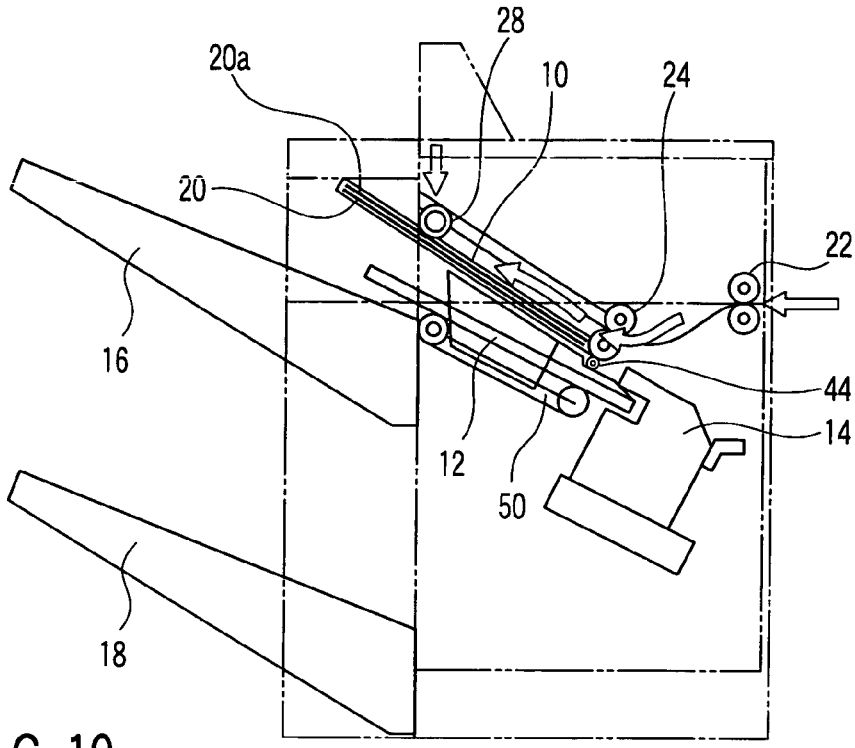
FIG. 10 is a sectional view of the post-process apparatus, showing how the waiting-tray rollers operate.

As FIG. 10 shows, the second sheet 20 is conveyed to the waiting tray 10. The waiting-tray rollers 28 move down, aligning the trailing edge of the second sheet 20*a* at the rear end 60 of the waiting tray 10. Thus, a bundle 20*b* of two sheets 20 and 20*a* is formed in the waiting tray 10.

Figure 11:
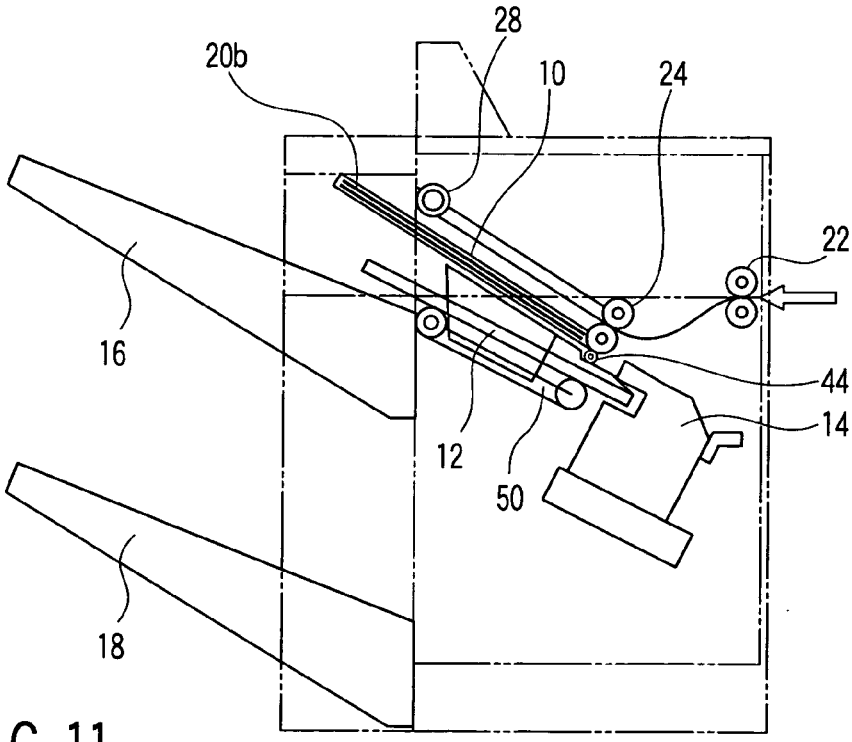
FIG. 11 is another sectional view of the apparatus, illustrating how the waiting-tray rollers operate.
Figure 12:
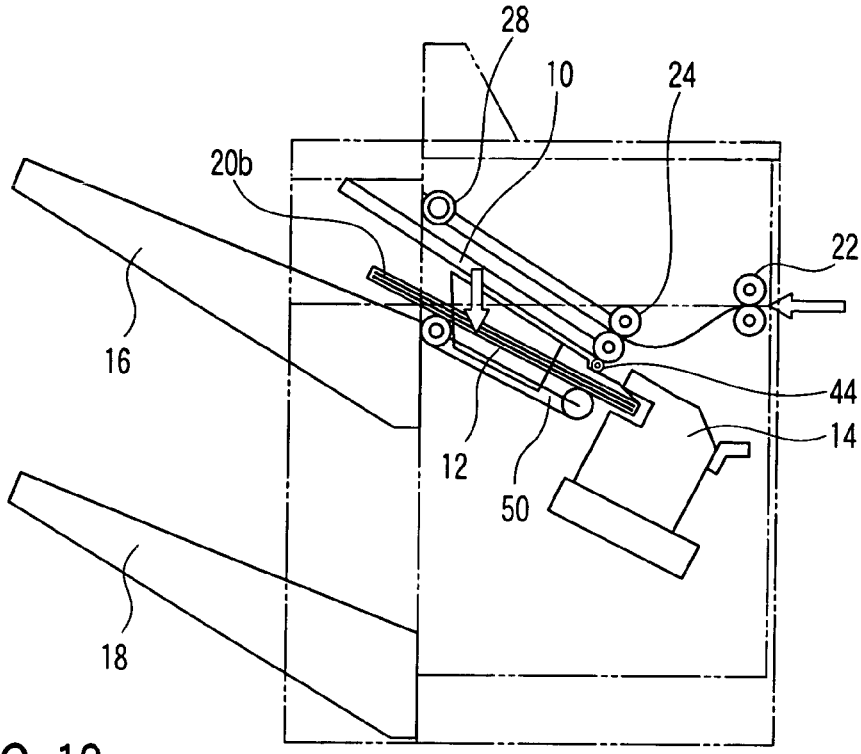
FIG. 12 is a sectional view of the apparatus, explaining how an active drop is carried out.

As FIG. 11 shows, the waiting-tray rollers 28 move upwards. Then, the waiting-tray parts 10*a* and 10*b* move to the opened position as is illustrated in FIG. 3. The active drop is therefore performed as shown in FIG. 12. The bundle 20*b* is conveyed to the processing tray 12.

Thereafter, the third sheet 20*c* and some following sheets are conveyed from the sheet-feeding rollers 24 to the processing tray 12, not through the waiting tray 10. These sheets are laid, one after another, upon the bundle 20*b* of two sheets. A bundle 21, which consists of the prescribed number of sheets, is formed on the processing tray 12. As the sheets including the third sheet 20 are sequentially laid on the bundle 20*b*, the longitudinal-alignment rollers 38 and the transverse-alignment mechanism 47 align the sheets at their longitudinal edges and transverse edges.

Figure 13:
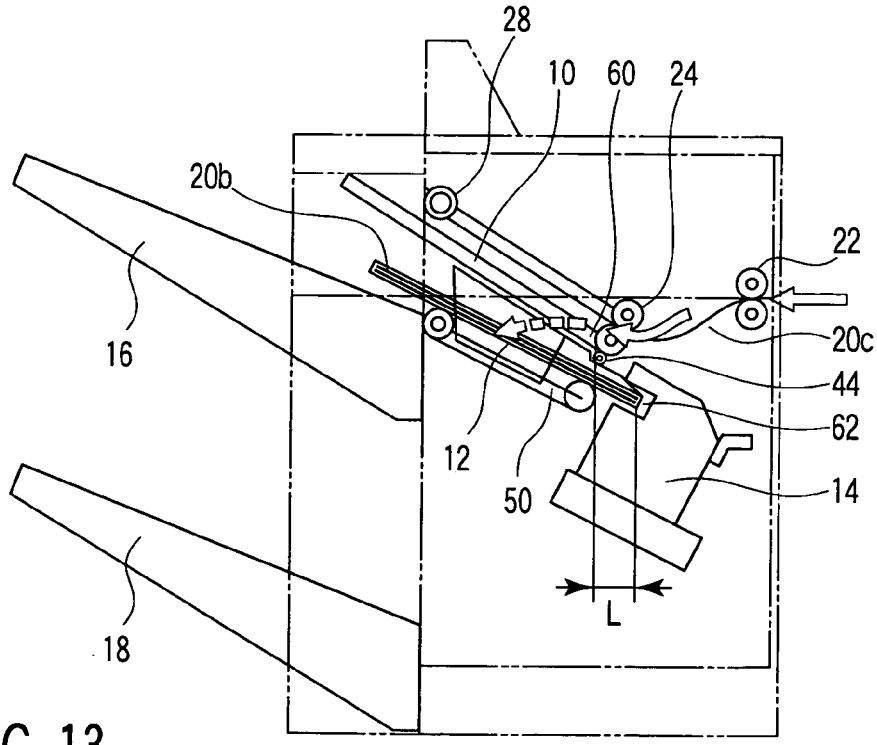
FIG. 13 is a sectional view of the apparatus, explaining how the third sheet is conveyed.

The waiting tray 10 must be positioned so that its rear end 60 may lie downstream of the rear end (upstream-side) of the processing tray 12 when the sheets are laid on the bundle 20*b*. As shown in FIG. 13, the rear end 60 of the waiting tray 10 is therefore spaced from the rear end 62 of the processing tray 12, by distance L, in the transverse direction. This enables the bundle 20*b* to fall smoothly from the waiting tray 10 onto the processing tray 12. This also makes it easy for both alignment mechanisms 38 and 47 to align sheets. Thus, jamming of sheets can be prevented.

It is desired that the waiting tray 10 and the processing tray 12 be inclined, having their upstream ends at a lower position than their downstream ends. In other words, they should be so positioned that their rear ends 60 and 62 lie at the lowest position. If the trays 10 and 12 are so inclined, the sheets 20 are aligned, due to gravity, at the rear end 60 of the waiting tray 10, and the bundle 20*b* can be aligned, due to gravity, at the rear end and 62 of the processing tray 12.

As seen from FIGS. 10 to 13, the sheet post-process apparatus has the following three characterizing features:

(1) The waiting tray 10 extends longer in the sheet-conveying direction than the length of sheets 20.

(2) The processing tray 12 extends shorter in the sheet-conveying direction than the length of sheets 20.

(3) Because of the feature (2), any sheet 20 that has fallen from the waiting tray 10 onto the processing tray 12 is supported not only by the processing tray 12, but also by the first storage tray 16.

These features (1), (2) and (3) reduce the size of the sheet post-process apparatus (i.e., finisher) in the sheet-conveying direction.

Figure 14:
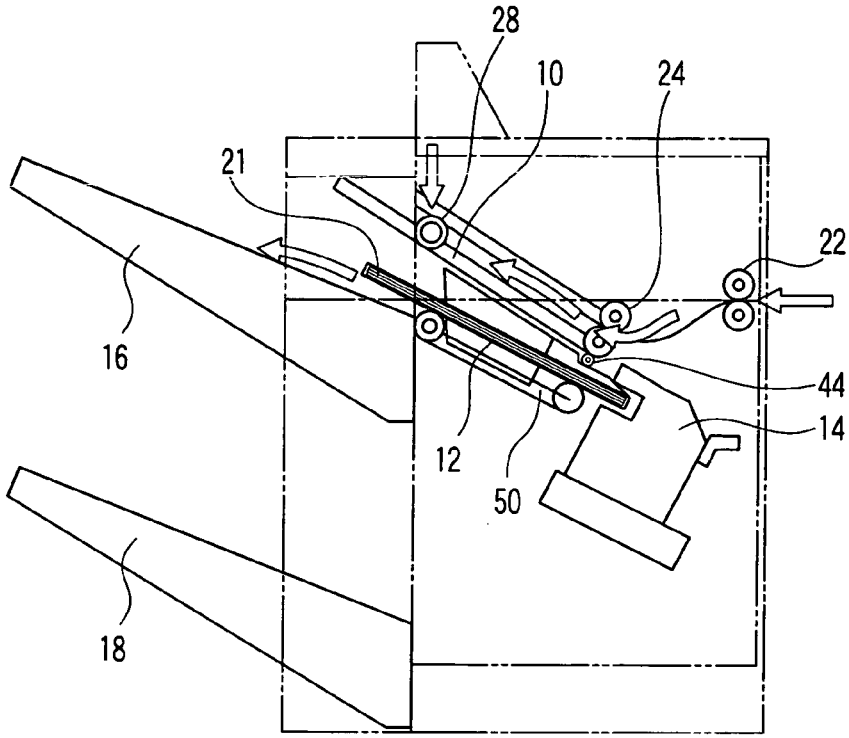
FIG. 14 is a sectional view of the apparatus, illustrating how the stapler operates.
Figure 15:
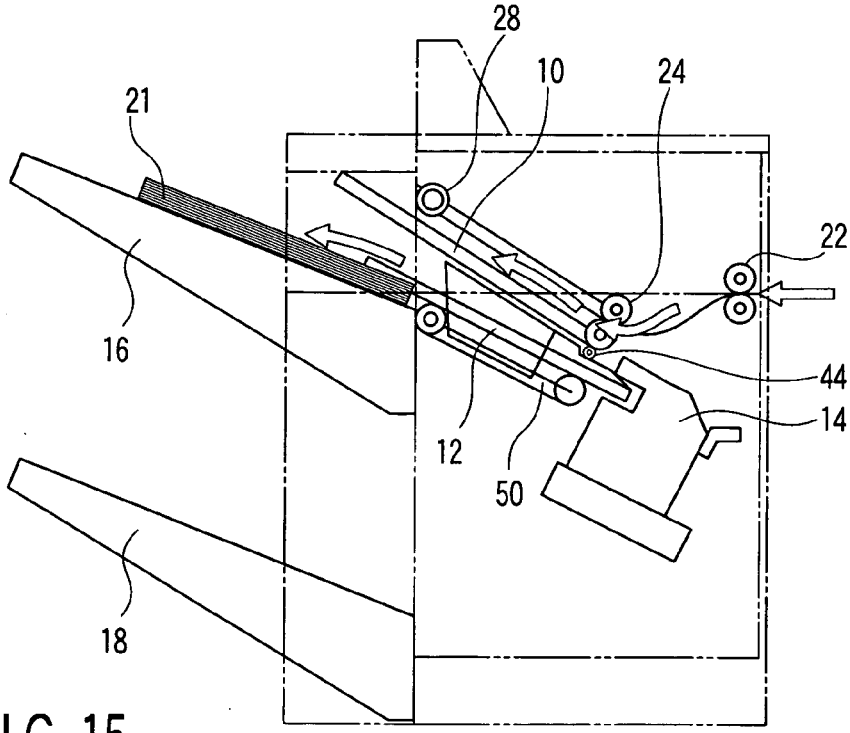
FIG. 15 is a sectional view of the apparatus, explaining how a bundle of sheets moves between the processing tray and the storage tray.

As FIG. 14 shows, the stapler 14 staples the bundle 21 of sheets. Then, the transport mechanism 50 transports the bundle 21 to the storage tray 16 as illustrated in FIG. 15. Thus, the post-process ends.

Figure 16:
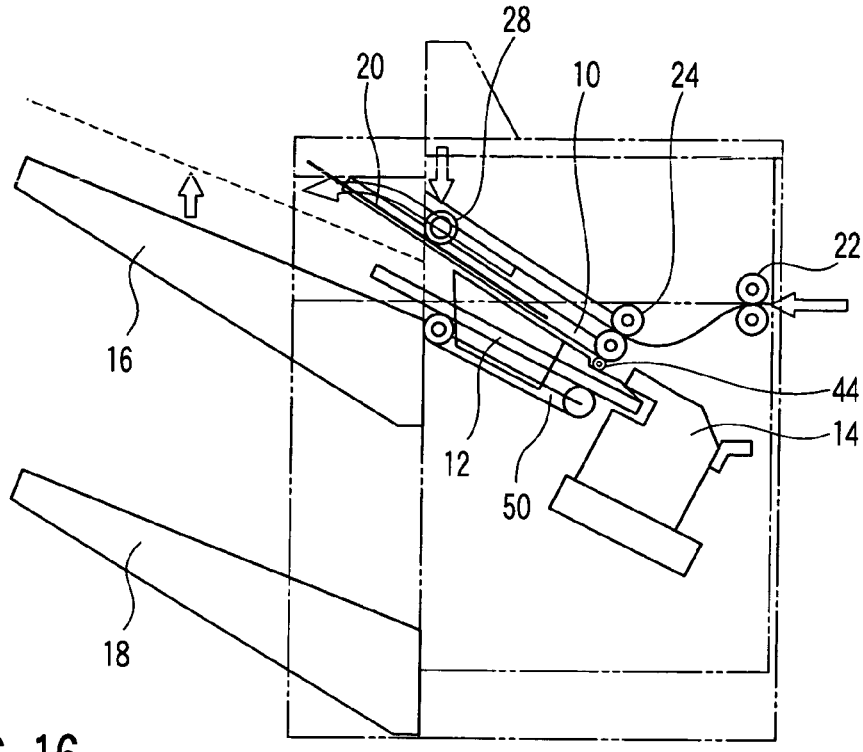
FIG. 16 is a sectional view of the apparatus, illustrating how sheets move from the waiting tray to the storage tray.
Figure 17:
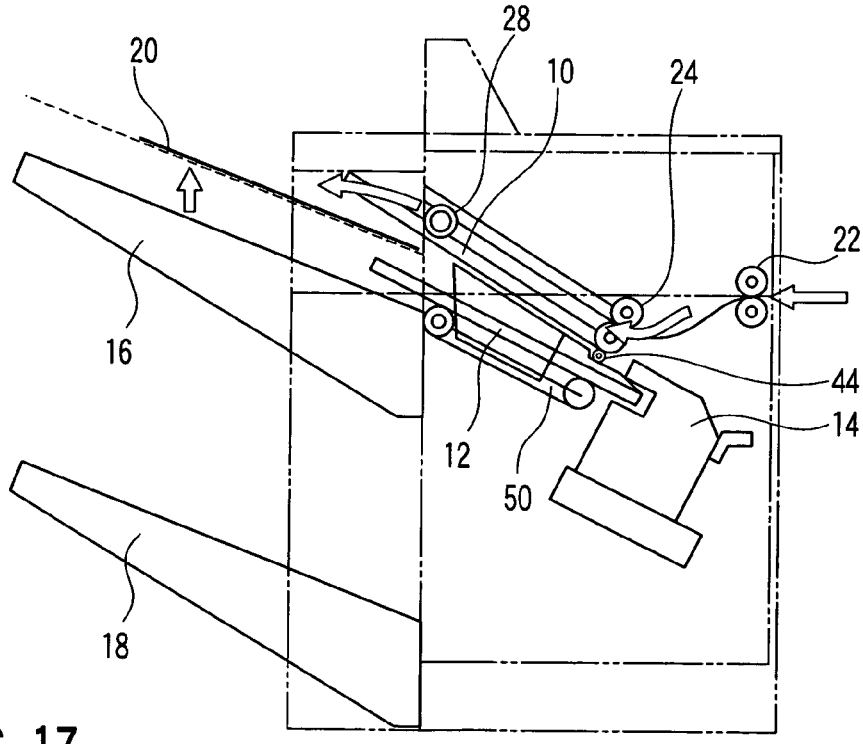
FIG. 17 is a sectional view of the apparatus, explaining how the position of the storage tray is changed.

If the sheets need not undergo the post-process, they are not conveyed to the processing tray 12. They are ejected from the waiting tray 10 onto the first storage tray 16 as shown in FIGS. 16 and 17. As FIG. 16 shows, the sheets supplied from the MFP are sequentially conveyed to the first storage tray 16 via the input rollers 22, sheet-feeding rollers 24 and waiting tray 10. The waiting-tray rollers 28 move down, serving to convey sheets 20. As depicted in FIG. 17, the storage-tray driving unit 52 lifts the first storage tray 16 a little and receives the sheets coming from the waiting tray 10.

The post-process apparatus has a mechanism that controls the speeds of rotation of the input rollers 22 and sheet-feeding rollers 24. This mechanism will be described with reference to FIG. 18.

Figure 18:
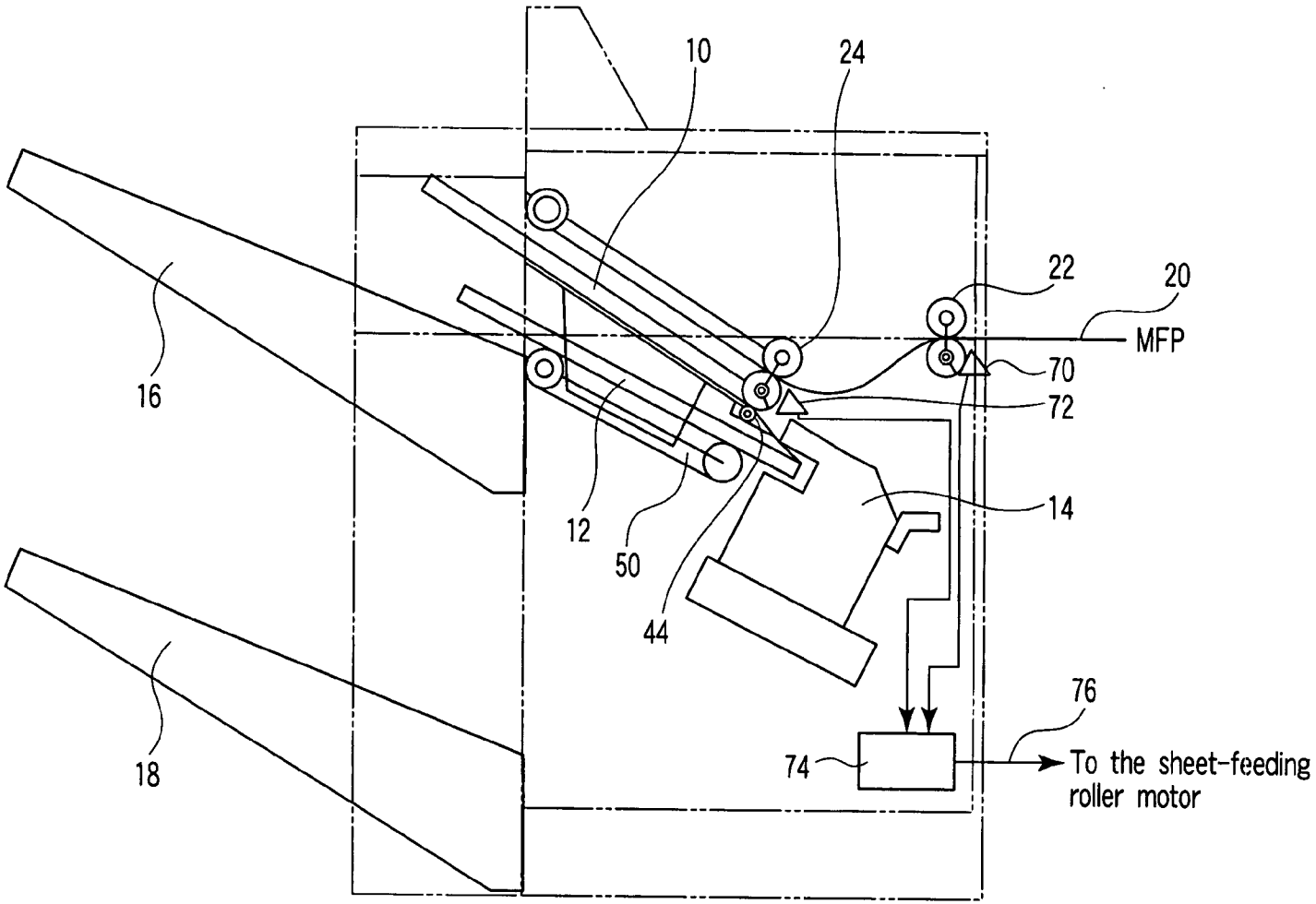
FIG. 18 is a sectional view of the apparatus, explaining the speed control mechanism that controls the speeds at which the input rollers and sheet-feeding rollers are rotated.

As FIG. 18 depicts, a entrance sensor 70 is provided at the nip between the input rollers 22, to which a sheet 20 is conveyed, and a sheet sensor 72 is provided at upstream of the sheet-feeding rollers 24. The entrance sensor 70 detects the leading edge and trailing edge of the sheet 20. The sheet sensor 72 detects the leading edge of the sheet 20. The output signals of the entrance sensor 70 and sheet sensor 72 are supplied to a speed-controlling unit 74. The unit 74 generates a control signal 76 from the output signals of the sensors 70 and 72. The control signal 76 is supplied to a sheet-feeding roller motor (not shown). Controlled by the signal 76, the motor drives the sheet-feeding rollers 24 at a specific speed.

Figure 19:
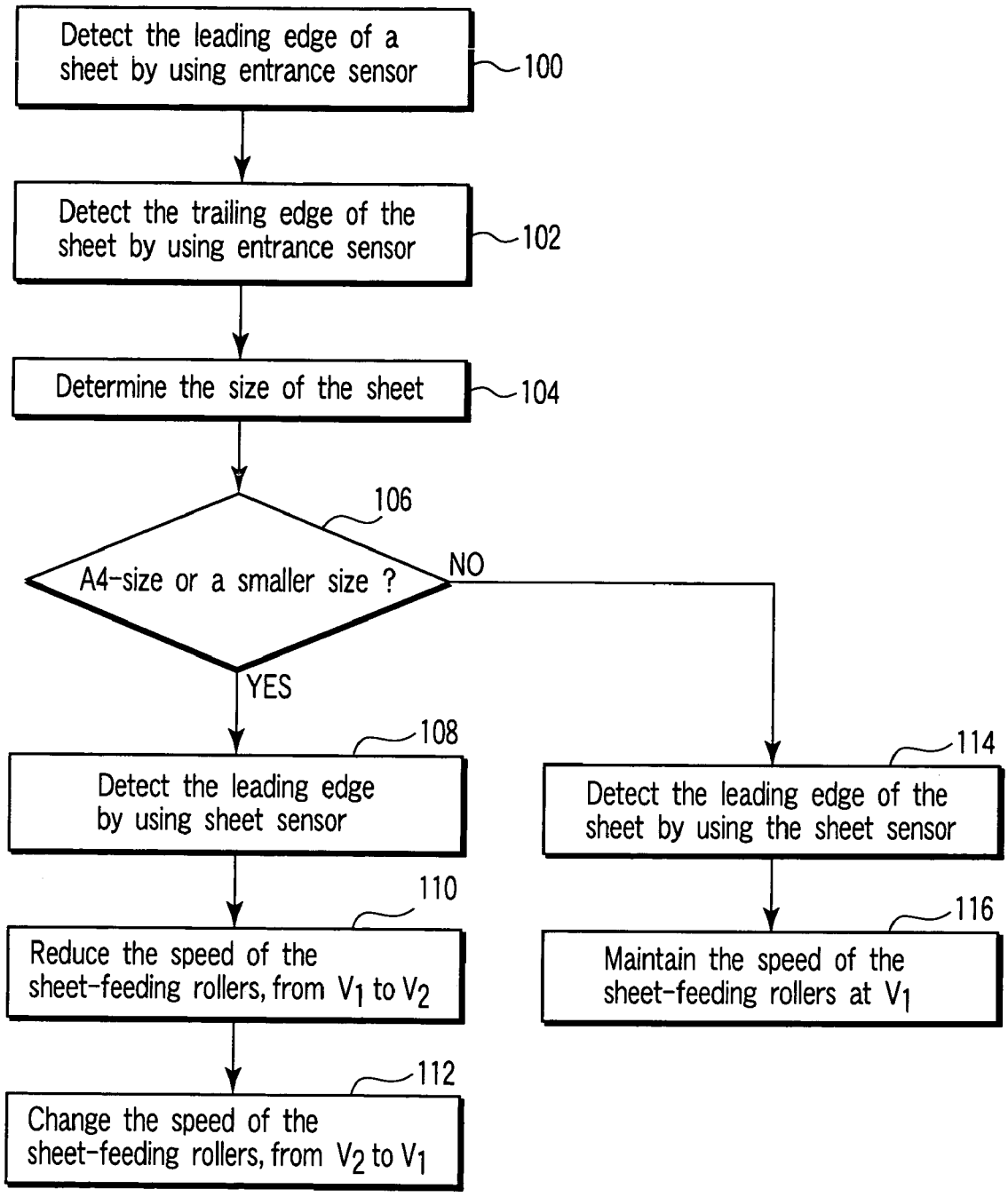
FIG. 19 is a flowchart explaining how the speed control mechanism controls the speeds of rotation of the input rollers and sheet-feeding rollers.

How the speed of rotation of the sheet-feeding rollers 24 is controlled will be explained, with reference to the flow-chart of FIG. 19.

When a sheet 20 is conveyed from the MFP to the post-process apparatus, the input rollers 22 and the sheet-feeding rollers 24 are rotated at the same speed V1. In Step 100, the entrance sensor 70 detects the leading edge of the sheet 20 conveyed to the post-process apparatus, generating a signal. In Step 102, the entrance sensor 70 detects the trailing edge of the sheet 20, generating a signal. The two signals thus generated are supplied to the speed-controlling unit 74. In Step 104, the speed-controlling unit 74 finds the size of the sheet 20 from the speed V1 of the input rollers 22.

In Step 106, the speed-controlling unit 74 determines whether the sheet 20 has the A4 size or a smaller size. If YES, the operation goes to Step 108. In Step 108, the sheet sensor 72 detects the leading edge, the speed-controlling unit 74 generates a control signal 76. In Step 110, the signal 76 is supplied to the sheet-feeding roller motor to decrease the speed of the motor from V1 to V2. V1≧V2, but V1=V2 if the sheet 20 is an A4-size sheet.

In Step 112, the speed-controlling unit 74 changes the speed of the sheet-feeding rollers 24 back to V1 when the sheet 20 is conveyed to the waiting tray 10.

If NO in Step 106, or if the sheet 20 has a size larger than the A4 size, the operation goes to Step 114. In Step 114, the sheet sensor 72 detects the leading edge of the sheet 20. Nevertheless, the speed of the sheet-feeding rollers 24 is maintained at V1 in Step 116.

In the embodiment, the speed of the sheet-feeding rollers 24 is controlled in accordance with the data acquired within the post-process apparatus. Instead, the speeds of conveying sheets of different sizes can be controlled in accordance with the job information generated in the MFP.

Thus, the speed of the sheet-feeding rollers 24 is controlled on the basis of the data about the sheet 20. This renders the post-process apparatus compatible with various types of MFPs. For the same reason, the post-process apparatus can work together with any MFP even if the MFP is altered in specification.

Furthermore, the post-process apparatus can perform a post-process on sheets, regardless of the thickness of the sheets.

One embodiment of the invention has been described. The invention is not limited to the embodiment, nevertheless. The components described above may be replaced with other components that are identical in function.

What is claimed is:

1. A sheet post-process apparatus, comprising:

a plurality of input rollers which receive sheets from a multi-function peripheral and convey the sheets forward;

sheet-feeding rollers which are provided downstream from the plurality of input rollers and receive the sheets from the plurality of input rollers;

a waiting tray which is provided in a conveying path and holds some of the sheets conveyed from the sheet-feeding rollers when a bundle of sheets needs to be post-processed;

a control mechanism which controls a speed of the sheet-feeding rollers provided upstream of the waiting tray, the control mechanism using a detected leading edge of the sheets to control the speed of the sheet-feeding rollers;

a processing tray which holds the sheets conveyed from the waiting tray and other sheets forming the bundle of sheets, before the bundle of sheets is post-processed; and a post-process mechanism which performs a post-process on the bundle of sheets on the processing tray, comprising:

a first sensor that detects sheet information supplied from the multi-function peripheral and the leading edge of the sheets;

a second sensor provided between the first sensor and the waiting tray, that detects the leading edge of the sheets; and a control unit that generates a control signal for controlling the speed of the sheet-feeding rollers, from the sheet information and the leading edge detected by the first and second sensors.

2. The sheet post-process apparatus according to claim 1, wherein the control mechanism controls the speed of the sheet-feeding rollers in accordance with job information supplied from the multi-function peripheral.

3. The sheet post-process apparatus according to claim 1, wherein the control mechanism controls the speed of the sheet-feeding rollers in accordance with information representing a size of the sheets.

4. The sheet post-process apparatus according to claim 1, further comprising a sheet-conveying mechanism which conveys the post-processed bundle of sheets from the processing tray.

5. The sheet post-process apparatus according to claim 4, further comprising a storage tray which stacks the bundle of sheets conveyed by the sheet-conveying mechanism.

6. The sheet post-process apparatus according to claim 1, wherein the processing tray holds the other sheets conveyed via the conveying path without being conveyed to the waiting tray before the bundle of sheets is post-processed.

7. The sheet post-process apparatus according to claim 1, wherein the waiting tray includes an alignment mechanism.

8. The sheet post-process apparatus according to claim 1, wherein the processing tray includes an alignment mechanism.

9. A sheet post-process apparatus, comprising:

a plurality of input rollers which receive sheets from a multi-function peripheral and convey the sheets forward;

sheet-feeding rollers which are provided downstream from the plurality of input rollers and receive the sheets from the plurality of input rollers;

a waiting tray which is provided in a conveying path and holds some of the sheets conveyed from the sheet feeding rollers when a bundle of sheets needs to be post-processed;

means for controlling a speed of the sheet-feeding rollers provided upstream of the waiting tray, the means for controlling using a detected leading edge of the sheets to control the speed of the sheet-feeding rollers; and a processing tray which holds the sheets conveyed from the waiting tray and other sheets forming the bundle of sheets, before the bundle of sheets is post-processed; and a post-process mechanism which performs a post-process on the bundle of sheets on the processing tray, comprising:

first detecting means for detecting sheet information supplied from the multi-function peripheral and a leading edge of the sheets;

second detecting means for detecting the leading edge of the sheets provided between the first detecting means and the waiting tray; and control means for generating a control signal for controlling the speed of the sheet-feeding rollers, from the sheet information and the leading edge detected by the first and second detecting means.

10. The sheet post-process apparatus according to claim 9, wherein the means for controlling controls the speed of the sheet-feeding rollers in accordance with job information supplied from the multi-function peripheral.

11. The sheet post-process apparatus according to claim 9, wherein the means for controlling controls the speed of the sheet-feeding rollers in accordance with information representing a size of the sheets.

12. The sheet post-process apparatus according to claim 9, further comprising a sheet-conveying mechanism which conveys the post-processed bundle of sheets from the processing tray.

13. The sheet post-process apparatus according to claim 12, further comprising a storage tray which stacks the bundle of sheets conveyed by the sheet-conveying mechanism.

14. The sheet post-process apparatus according to claim 9, wherein the processing tray holds the other sheets conveyed via the conveying path without being conveyed to the waiting tray before the bundle of sheets is post-processed.

15. The sheet post-process apparatus according to claim 9, wherein the waiting tray includes an alignment mechanism.

16. The sheet post-process apparatus according to claim 9, wherein the processing tray includes an alignment mechanism.

17. A method for post-processing sheets, comprising:

receiving sheets by a plurality of input rollers from a multi-function peripheral;

conveying the sheets forward through a conveying path by a plurality of sheet-feeding rollers;

detecting a leading edge of the sheets when being conveyed;

holding some of the sheets conveyed from the sheet-feeding rollers on a waiting tray;

controlling a speed of the sheet-feeding rollers using the detected leading edge of the sheets;

receiving the sheets from the waiting tray and other sheets forming a bundle of sheets before the bundle of sheets is post-processed on a processing tray; and carrying out a post-processing operation on the bundle of sheets on the processing tray, comprising:

detecting sheet information supplied from the multi-function peripheral and the leading edge of the sheets by a first sensor;

detecting the leading edge of the sheets by a second sensor provided between the first sensor and the waiting tray; and generating a control signal for controlling the speed of the sheet-feeding rollers, from the sheet information and the leading edge detected by the first and second sensors.

* * * * *